United States Patent [19]

Schisler

[11] Patent Number: 4,796,759

[45] Date of Patent: Jan. 10, 1989

[54] BUNDLE OF SUPPLE BAGS, MADE OF FINE MATERIAL SUCH AS PLASTICS MATERIAL OR PAPER

[75] Inventor: Jacques Schisler, Thouars, France

[73] Assignee: C.E.E. Compagnie Europeene des Emballages, Thuoars, France

[21] Appl. No.: 139,306

[22] Filed: Dec. 29, 1987

[51] Int. Cl.[4] ..... B65D 27/10

[52] U.S. Cl. ..... 206/554; 383/37

[58] Field of Search ..... 206/449, 554; 383/8, 383/9, 12, 13, 37, 120

[56] References Cited

U.S. PATENT DOCUMENTS

| | | | |
|---|---|---|---|
| 2,688,435 | 9/1954 | Vogt . | |
| 2,715,493 | 8/1955 | Vogt . | |
| 2,725,141 | 11/1955 | Latvala et al. . | |
| 3,380,579 | 4/1968 | Pinto . | |
| 3,915,302 | 10/1975 | Farrelly et al. . | |
| 4,479,979 | 10/1984 | Reimann et al. | 206/554 |
| 4,480,750 | 11/1984 | Dancy | 206/554 |
| 4,493,419 | 1/1985 | Prader et al. | 206/554 |
| 4,529,090 | 7/1985 | Pilon | 206/554 |
| 4,560,067 | 12/1985 | Reimann . | |
| 4,562,925 | 1/1986 | Pistner | 206/554 |
| 4,676,378 | 6/1987 | Baxley et al. | 206/554 |

FOREIGN PATENT DOCUMENTS

| | | | |
|---|---|---|---|
| 0136171 | 4/1985 | European Pat. Off. . | |
| 1958690 | 5/1971 | Fed. Rep. of Germany | 206/554 |
| 2314871 | 1/1977 | France | 206/554 |
| 2159493 | 12/1985 | United Kingdom | 383/37 |

*Primary Examiner*—Jimmy G. Foster

*Attorney, Agent, or Firm*—McAulay, Fields, Fisher, Goldstein & Nissen

[57] ABSTRACT

A bundle of supple bags for carrying articles comprises superposed bags joined in series by a separable connection of each of their two principal walls with the adjacent principal wall of an adjacent bag, in the vicinity of the opening. The separable connection is constituted by a glued or welded localized zone below the center of the edge of the opening. Each bag comprises, above this glued or welded localized zone, at least one support tongue which is joined in separable manner to at least the rear principal wall of the bag considering the direction of removal, this tongue being joined to the edge of said principal wall defining the opening of the bag and presenting at least one hole for the passage of a rod.

15 Claims, 1 Drawing Sheet

BUNDLE OF SUPPLE BAGS, MADE OF FINE MATERIAL SUCH AS PLASTICS MATERIAL OR PAPER

BACKGROUND OF THE INVENTION

The present invention relates to a bundle of supple bags, made of fine material such as plastics material or paper, which are used in stores or supermarkets for carrying the purchased articles, and which lends itself particularly well to semi-automatic packaging.

The supple bags which are used at present in stores or supermarkets are made of very fine sheets of plastics material, for example polyethylene. These bags generally comprise two adjacent principal walls, namely a front wall and a rear wall, joined together by a bottom and possibly by lateral gussets, and they are extended, at their top, by handles which facilitate transport thereof. These known bags are unsuitable for use in a bundle in dispensers which automatically open each bag. In fact, the two principal walls of each bag generally adhere to each other due to the phenomenon of electrostatic attraction and it is consequently difficult to open them and to separate each individual bag from the rest of the bundle of which it is part.

Bundles of bags which are attached to one another in such a manner as to open one after the other when the first bag of the bundle is pulled, are already known,. Such bundles of bags are described for example in U.S. Pat. Nos. 3,380,579 and 3,915,302. However, such bundles present the drawback of not being easy to manufacture automatically and continuously and of having a relatively high cost price.

SUMMARY OF THE INVENTION

It is an object of the present invention to overcome these drawbacks by providing a bundle of bags of very simple design, lending itself well to the opening of the individual bags in a dispenser and which is easy to manufacture continuously on an automatic machine.

To that end, this bundle of supple bags for carrying articles, in which each bag comprises two front and rear principal walls defining a volume which presents a bottom and an upper opening, the superposed bags of the bundle being adapted to be supported by at least two parallel rods passing through aligned holes made in the bags of the bundle, the bags being joined in series by a separable connection of each of their two principal walls with the adjacent principal wall of an adjacent bag, in the vicinity of said opening, the assembly being such that the first bag is removed by pulling thereon in the direction of superposition in order to separate the first bag from the following by destroying said connection, such removal being accompanied by a spacing apart of the principal walls of the following bag due to said pulling, is characterized in that the separable connection is constituted by a glued or welded localized zone below the centre of the edge of the opening, and in that each bag comprises, above this glued or welded localized zone, at least one support tongue which is joined in separable manner to at least the rear principal wall of the bag, considering the diretion of removal, this tongue being joined to the edge of said principal wall defining the opening of the bag and presenting at least one hole for the passage of a rod.

BRIEF DESCRIPTION OF THE DRAWINGS

The invention will be more readily understood on reading the following description with reference to the accompanying drawings, in which.

DESCRIPTION OF THE PREFERRED EMBODIMENTS

Figure 1:
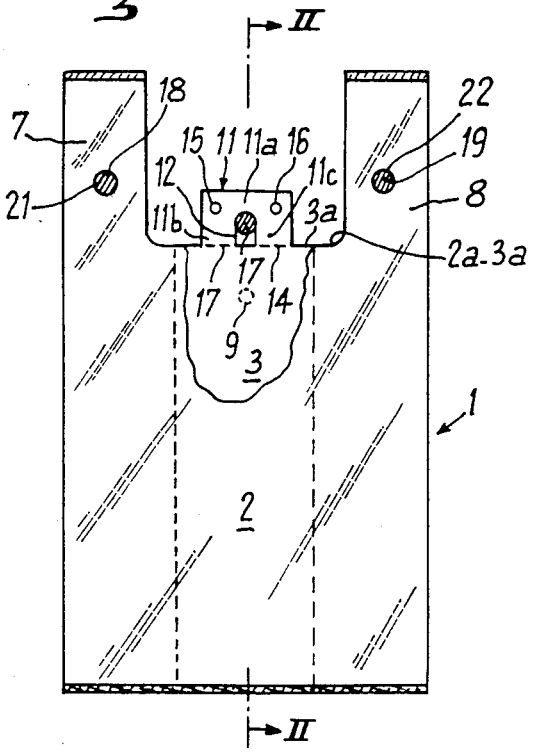
FIG. 1 is a view in elevation of a supple bag of fine plastics material forming part of a bundle of bags according to the invention.
Figure 2:
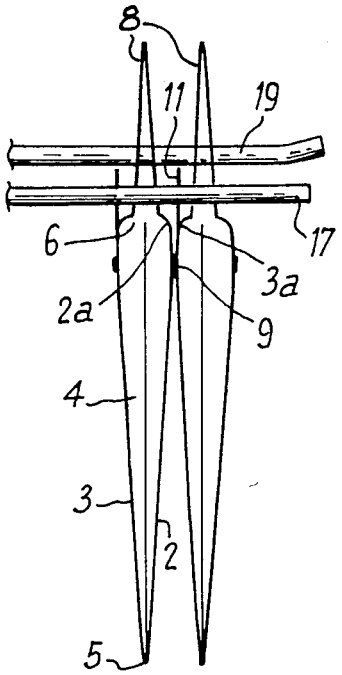
FIG. 2 is a view in vertical and longitudinal section made along line II—II of FIG. 1.
Figure 3:
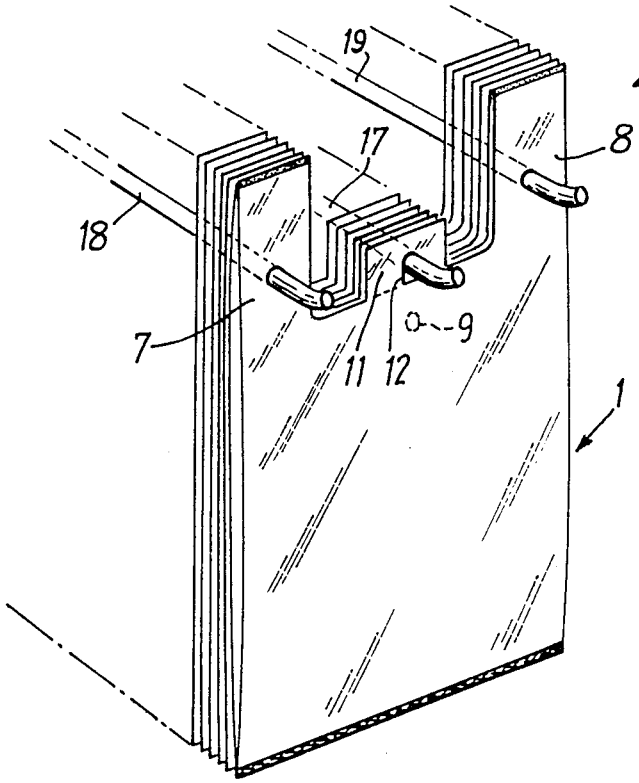
FIG. 3 is a view in perspective of a bundle of bags according to the invention placed on an individual bag dispenser.

Referring now to the drawings, FIGS. 1 to 3 show a bundle of individual bags 1 which are made of a fine plastics material such as polyethylene. Each bag 1 comprises two principal walls, namely a front wall 2 and a rear wall 3 which define a volume 4 for carrying articles, this volume 4 possibly being closed laterally by gussets and being closed at its lower end by a bottom 5 and defining an upper opening 6 for introducing the articles in the bag. The principal walls 2,3 extend upwardly, on both sides of the upper opening 6, by lateral handles 7 and 8 which enable the filled bag to be carried.

According to the invention, the individual bags 1 are joined to one another by glued or welded localized zones 9 which are provided just below the centres of the upper edges 2*a*, 3*a* of the principal walls 2,3 defining the opening 6. More particularly, each glued or welded localized zone 9 ensures a connection between the rear wall 3 of a forward bag and the rear wall 2 of a following bag, as may be seen in FIG. 2.

The localized connection zone 9 may easily be obtained, when mass-producing the bags, by depositing a single drop of glue at the spot provided on each bag, during advance of this bag at a gluing station.

According to another feature of the invention, each bag comprises, above glued or welded localized connecting zone 9, a support tongue 11 which is joined in a separable manner to at least one of the principal walls 2, 3 of each bag 1, in the present case to the rear wall 3 as may be seen in FIG. 2. This support tongue 11 extends upwardly from the upper edge 3*a* of the rear wall 3, in the space defined between the two lateral handles 7,8. Each support tongue 11 is advantageously rectangular in shape, shorter than the height of the lateral handles 7, 8 and it is pierced, in the zone where it is attached to the edge 3*a*, with a central hole 12 in the form of an upturned U, which terminates at the level of the upper edge 3*a*. Consequently, the support tongue 11 has the form of an arch comprising an upper horizontal web 11*a*, extending above the hole 12, and two vertical wings 11*b*, 11*c* extending downwardly and which respectively join the upper edge 3*a* of the rear wall 3 of the bag by horizontal lines 13,14 of least resistance. These lines 13,14 are constituted, for example, by fine perforations, which form part of the upper edge 3*a* of the bag 3 after the separation of the support tongue 11.

Each support tongue 11 contributes to facilitating opening of each bag 1, by retaining somewhat the upper central part of the rear wall, without, however, opposing separation of the bag 1 from its support tongue 11 when the bag is pulled sufficiently strongly.

The support tongues 11 may advantageously be fixed to one another by zones of join 15,16 distibuted along two longitudinal lines of join located on either side of the central hole 12 and perpendicular to the plane of the superposed bags 1 constituting the bundle. These lines of join 15,16 may be constituted by a succession of glued or welded zones or by connecting members passing through holes made in the superposed support tongues 11.

As shown in FIG. 3, the central holes 12 of the support tongues 11 serve for the passage of a rod 17 forming central support which may be provided, at its front end, with a stop member preventing forward displacement of the support tongues 11. This stop member may be constituted by the upwardly curved front end of the support rod 17.

Other support rods 18,19 are provided laterally to support the bundle of bags, these support rods passing through holes 21,22 provided respectively in the two lateral handles 7,8 of the bags.

I claim:

1. A bundle of supple bags for carrying articles, in which each said bag comprises:

a front and a rear principal wall defining a volume which presents a bottom and an upper opening;

each said principal wall including a pair of spaced lateral handles having aligned holes therethrough, the superimposed bags of the bundle being adapted to be supported by at least two parallel rods passing through said holes;

said bags being joined in series by a separable connection of each of their two principal walls with the adjacent principal wall of an adjacent bag, in the vicinity of said opening, the assembly being such that the first bag is removed by pulling thereon in the direction of superposition in order to separate the first bag from the following by destroying said connection, such removal being accompanied by a spacing apart of the principal walls of the following bag due to said pulling, wherein the separable connection is constituted by a glued or welded localized zone below the center of the edge of the opening; and each said bag comprises, above this glued or welded localized zone and between said lateral handles, a single support tongue having an elongated opening and base portions on each side of said elongated opening, said base portions being joined in separable manner to at least one of said principal walls of said bag, considering the direction of removal, the base portions of said tongue being joined to the edge of said one principal wall defining the opening of the bag and forming at least one central hole for the passage of another rod separate and apart from said at least two parallel rods;

said elongated opening defining said central hole terminating at the upper edge of said principal wall to which said base portions are connected.

2. The bundle of supple bags according to claim 1, wherein said support tongue is pierced, in the zone where it is attached to its line of separation, with a central inverted U-shaped hole defined, in part, by said base portions to form two wings extendng on either side of said central hole and a central part of the upper edge of one of said principal walls of the bag so that the support tongue has the form of an arch joined to the principal wall of the bag solely by said two wings which extend on either side of said central hole.

3. The bundle of supple bags according to claim 2, wherein said support tongues are fixed to one another by localized connection zones distributed along two lines of join located on either side of the central hole and perpendicular to the plane of the superimposed bags.

4. The bundle of supple bags according to claim 1, including means fixing said support tongues to one another, including localized connection zones distributed along two lines of join located on either side of said central hole and perpendicular to the plane of the superimposed bags.

5. The bundle of supple bags according to claim 1, wherein said opening in said tongue is in the form of an upturned U to form an upper horizontal web extending above said opening and said base portions forming two vertical wings extnding downwardly and respectively joining the upper edge of said rear principal wall.

6. The bundle of bags according to claim 5, wherein the joinder of said vertical wings to said rear principal wall is formed of lines of least resistance whereby to facilitate removal of each individual bag from said bundle of bags by causing said tongue to separate from said rear principal wall and not said spaced lateral handles.

7. The bundle of bags according to claim 6, wherein said lines of least resistance are formed by fine perforations forming part of said upper edge of said principal wall.

8. The bundle of bags according to claim 7, wherein each said support tongue is sufficiently strongly connected to said rear principal wall to cooperate with said wings to facilitate opening of each said bag by retaining the upper central part of said rear principal wall without opposing separation of said tongue along said lines of least resistance from said rear principal wall of said bag.

9. The bundle of bags according to claim 6, wherein each said support tongue is sufficiently strongly connected to said rear principal wall to cooperate with said wings to facilitate opening of each said bag by retaining the upper central part of said rear principal wall without opposing separation of said tongue along said lines of least resistance from said rear principal wall of said bag.

10. The bundle of supple bags according to claim 9, wherein said support tongues include zones of joinder distributed along two longitudinal lines of join located on either side of said central hole.

11. The bundle of supple bags according to claim 10, wherein said lines of join include a succession of glued or welded zones.

12. The bundle of bags according to claim 1, wherein each said support tongue is rectangular in shape and shorter in height than said handles.

13. The bundle of supple bags according to claim 1, wherein said support tongues include zones of joinder distributed along two longitudinal lines of join located on either side of said central hole.

14. The bundle of supple bags according to claim 13, wherein said lines of join include a succession of glued or welded zones.

15. The bundle of supple bags according to claim 13, wherein said zones of joinder include connecting members passing through holes in said support tongues.

* * * * *